US011165205B2

(12) United States Patent
Dube et al.

(10) Patent No.: US 11,165,205 B2
(45) Date of Patent: Nov. 2, 2021

(54) MULTI-PHASE CONNECTOR FOR ELECTRIC POWERTRAIN SYSTEM

(71) Applicant: DANA TM4 INC., Boucherville (CA)

(72) Inventors: Francois Dube, Montreal (CA); Michel Brazeau, Delson (CA); Hakim Nechadi, Montreal (CA); Michael Rabo, Montreal (CA); Cristian Campean, St. Hubert (CA)

(73) Assignee: DANA TM4 INC., Boucherville (CA)

( * ) Notice: Subject to any disclaimer, the term of this patent is extended or adjusted under 35 U.S.C. 154(b) by 0 days.

(21) Appl. No.: 16/825,400

(22) Filed: Mar. 20, 2020

(65) Prior Publication Data

US 2020/0335915 A1 Oct. 22, 2020

Related U.S. Application Data

(60) Provisional application No. 62/836,110, filed on Apr. 19, 2019.

(51) Int. Cl.

| | |
|---|---|
| ***H01R 33/00*** | (2006.01) |
| ***H01R 13/6586*** | (2011.01) |
| ***H01R 13/187*** | (2006.01) |
| ***H01R 13/6596*** | (2011.01) |
| ***H01R 13/52*** | (2006.01) |
| *H01R 105/00* | (2006.01) |

(52) U.S. Cl.

CPC ..... *H01R 13/6586* (2013.01); *H01R 13/187* (2013.01); *H01R 13/5202* (2013.01); *H01R 13/6596* (2013.01); *H01R 2105/00* (2013.01); *H01R 2201/26* (2013.01)

(58) Field of Classification Search

CPC ..... H01R 13/6586; H01R 13/6596; H01R 13/5202; H01R 13/187; H01R 2105/00; H01R 2201/26

USPC ..... 439/34

See application file for complete search history.

(56) References Cited

U.S. PATENT DOCUMENTS

| | | | | |
|---|---|---|---|---|
| 2,735,993 | A * | 2/1956 | Humphrey | H01R 13/6276 439/348 |
| 3,821,618 | A * | 6/1974 | Guillemain | H01R 13/44 361/232 |
| 4,074,926 | A * | 2/1978 | Broad | H01R 13/53 439/89 |
| 4,420,202 | A | 12/1983 | Atakkaan | |
| 5,801,465 | A * | 9/1998 | Yamada | H01R 13/523 174/77 R |
| 6,910,910 | B2 * | 6/2005 | Cairns | G02B 6/3816 174/13 |
| 6,921,292 | B2 * | 7/2005 | Miyazaki | H01R 9/032 439/564 |

(Continued)

*Primary Examiner* — Abdullah A Riyami
*Assistant Examiner* — Vladimir Imas
(74) *Attorney, Agent, or Firm* — McCoy Russell LLP

(57) ABSTRACT

A multiphase connector for electric powertrain systems includes a terminal block and a plug member that are, at least in part, made from electrically conductive metal. The terminal block has at least one socket surrounding a retaining spring and the plug member has at least one contact pin configured to be inserted in to the at least one socket. The plug member can be engaged with the terminal block without use of installation tools and includes one or more cable gland assembly in contact with a shield of a shielded cable.

20 Claims, 12 Drawing Sheets

(56) References Cited

U.S. PATENT DOCUMENTS 7,011,544 B1 * 3/2006 Zemba ..... H01R 13/625 439/578
7,507,125 B2 * 3/2009 Okamura ..... H01R 13/506 439/680
7,613,003 B2 11/2009 Pavlovic et al.
7,614,910 B2 * 11/2009 Croteau ..... H01R 13/512 439/559
7,686,630 B2 3/2010 Takehara et al.
7,789,690 B1 9/2010 Rhein
7,942,699 B1 * 5/2011 Rossman ..... H01R 13/6582 439/607.41
7,959,454 B2 * 6/2011 Ramasubramanian ..... H01R 13/523 439/201
8,113,876 B1 * 2/2012 Rossman ..... H01R 13/6593 439/578
8,128,439 B2 * 3/2012 Feldmeier ..... H01R 13/6683 439/709
8,523,576 B2 9/2013 Heien et al.
8,696,376 B2 * 4/2014 Andresen ..... H01R 4/2433 439/391
8,753,133 B1 * 6/2014 Errato, Jr. ..... H01R 13/5845 439/108
8,784,139 B2 * 7/2014 Durand ..... G02B 6/4292 439/695
8,834,202 B2 * 9/2014 Kwasny ..... H01R 43/20 439/604
8,888,535 B2 * 11/2014 Knight ..... H01R 13/5221 439/650
8,942,532 B2 * 1/2015 Greub ..... G02B 6/3879 385/139
9,209,558 B2 * 12/2015 Greig ..... H01R 13/652
9,233,615 B2 * 1/2016 Matsuda ..... H01R 13/5841
9,293,871 B2 * 3/2016 Valadas ..... B60L 53/16
9,318,849 B2 * 4/2016 Kobayashi ..... H01R 13/5216
9,379,495 B2 * 6/2016 Valadas ..... H01R 13/7031
9,577,388 B2 2/2017 Umetsu et al.
9,620,905 B2 * 4/2017 Bergner ..... H01R 13/6594
9,722,364 B1 * 8/2017 Chueh ..... H02H 9/041
9,793,643 B2 * 10/2017 Whitacre ..... H01R 13/5202
9,866,006 B2 1/2018 Albert et al.
10,128,611 B2 11/2018 Rhein et al.
10,148,035 B2 * 12/2018 Finona ..... H01R 13/6315
10,236,095 B1 * 3/2019 Komer ..... F21V 23/06
10,586,632 B2 * 3/2020 Esmail ..... H01B 7/0275
10,704,353 B2 * 7/2020 Painter ..... H01R 13/523
10,819,073 B2 * 10/2020 Azad ..... H01R 13/6581
10,833,448 B2 * 11/2020 Janie ..... H02G 15/23
10,873,155 B2 * 12/2020 Haemmerling ..... H01R 13/635
2005/0252314 A1 11/2005 Vierkotter et al.
2013/0309888 A1 * 11/2013 Nicholson ..... E21B 17/025 439/271
2014/0065873 A1 * 3/2014 Franke ..... H02G 15/115 439/462
2014/0187080 A1 * 7/2014 Holland ..... H01B 7/0823 439/502
2018/0254030 A1 * 9/2018 Mayo ..... G10H 1/0091
2019/0027871 A1 1/2019 Data et al.

* cited by examiner

MULTI-PHASE CONNECTOR FOR ELECTRIC POWERTRAIN SYSTEM

CROSS-REFERENCE TO RELATED APPLICATIONS

The present application claims priority to U.S. Provisional Application No. 62/836,110, entitled "Multi-Phase Connector for Electric Powertrain System", and filed on Apr. 19, 2019. The entire contents of the above-listed application are hereby incorporated by reference for all purposes.

TECHNICAL FIELD

The present disclosure relates to multi-phase connectors, and in particular, to multi-phase connectors for electric powertrain systems.

BACKGROUND AND SUMMARY

In electric powertrain systems, electrical connectors are used to interconnect various system components such as an inverter to a battery or an inverter to a motor. In some examples, the electrical connectors need to be multiple phase connectors capable of handling high voltage. The multiphase connectors are generally divided into two families: quick-connectors and pass-through connectors.

Quick-connectors may include a plastic body with one or more clamping levers so that installation may be carried out without having to dissemble the connector and without demanding the use of a tool to tighten fasteners. The actual connectors may include two parts, a head portion that goes on the casing and a plug on a harness. It is known to feature a High Voltage Interlock Loop (HVIL) and/or keying options in such quick-connectors. The overall contact quality of the known quick-connectors is variable at least because of the possibility of relative movement between the plug and the header portion. Particularly, it was found that the shield contact may not be sufficiently robust for commercial vehicle use.

Conventional pass-through connectors may include a plastic body to be fastened onto a casing with fasteners. The connectors may be of lug and bolt construction, which may demand a fastening tool for installation. The HVIL may not be included in such pass-through connectors due to the use of tools to remove the HVIL, whereas keying options may be included in some examples. Pass-through connectors are generally characterized with a high quality contact as the body is firmly fastened to the casing, however, installation of the pass-through connectors may be cumbersome and time consuming due to the demand for tools.

Furthermore, known quick connectors and pass-through connectors provide poor shield contact that are, at least in part, attributable to the poor conductivity of their plastic body. As a result, such connectors may rely on complex shield contact design to overcome the issue of poor conductivity of the plastic body. Such complex shield contact may be costly to manufacture and to maintain. Thus, there may be a demand for an improved multiphase electrical connector that offers robust connection and easy installation.

In accordance with an example embodiment of the present disclosure, a multiphase connector for an electric powertrain system comprises a terminal block having a casing formed of a conducting metal with at least one socket surrounding a retaining spring and a plug member having at least one contact pin configured to be inserted into the at least one socket to fixedly engage the plug member with the terminal block without use of tools, the plug member including at least one cable gland assembly to ground the shielded cable and maintain electrical continuity between a shielded cable and the plug member. In this way, the terminal block and the plug member may be readily engaged/engaged with one another and provide a robust electrical connection.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

Reference will now be made, by way of example, to the accompanying drawings which show example embodiments of the present application, and in which:

FIGS. 1-11B are shown approximately to scale. Similar reference numerals may have be used in different figures to denote similar components.

DESCRIPTION OF EXAMPLE EMBODIMENTS

Figure 9A:
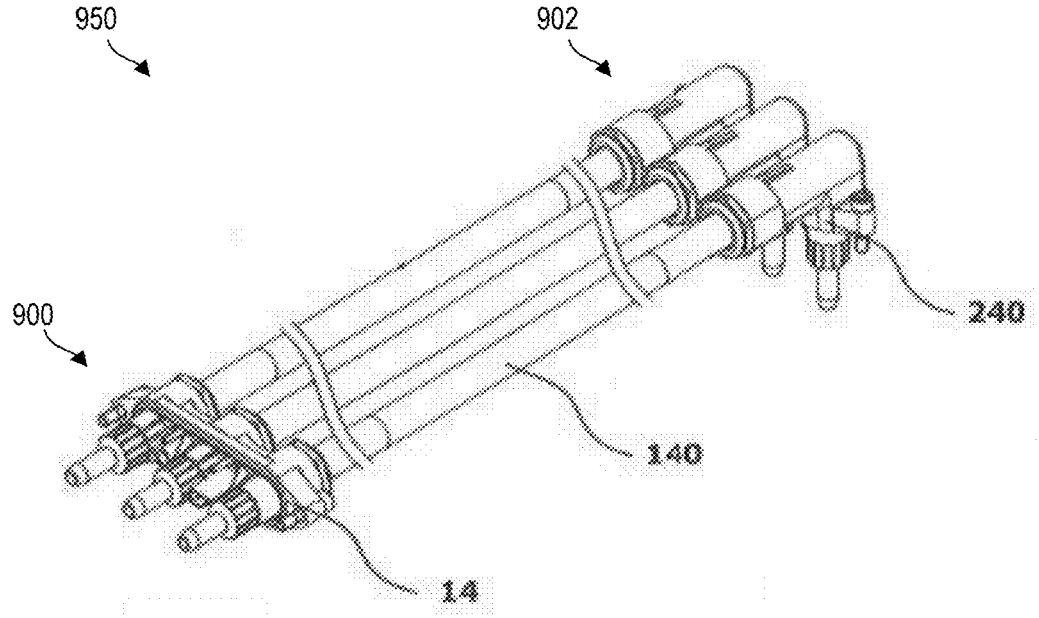
FIG. 9A shows a perspective view of a first example of a cable fitted with one straight plug member and one "L" shaped plug member.
Figure 9B:
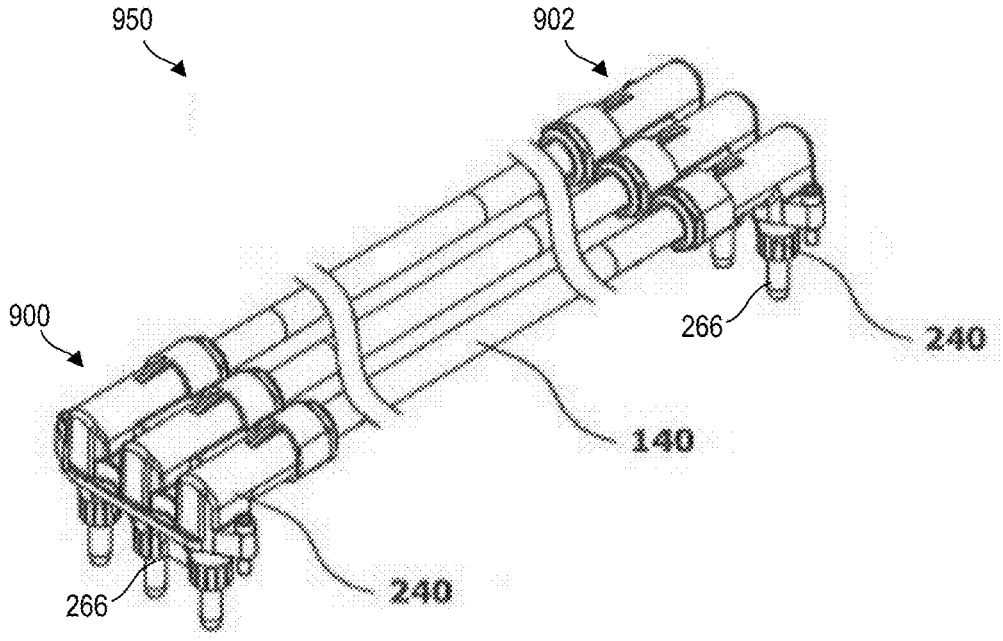
FIG. 9B shows a perspective view of a second example of a cable fitted with two "L" shaped plug members of the same configuration.
Figure 9C:
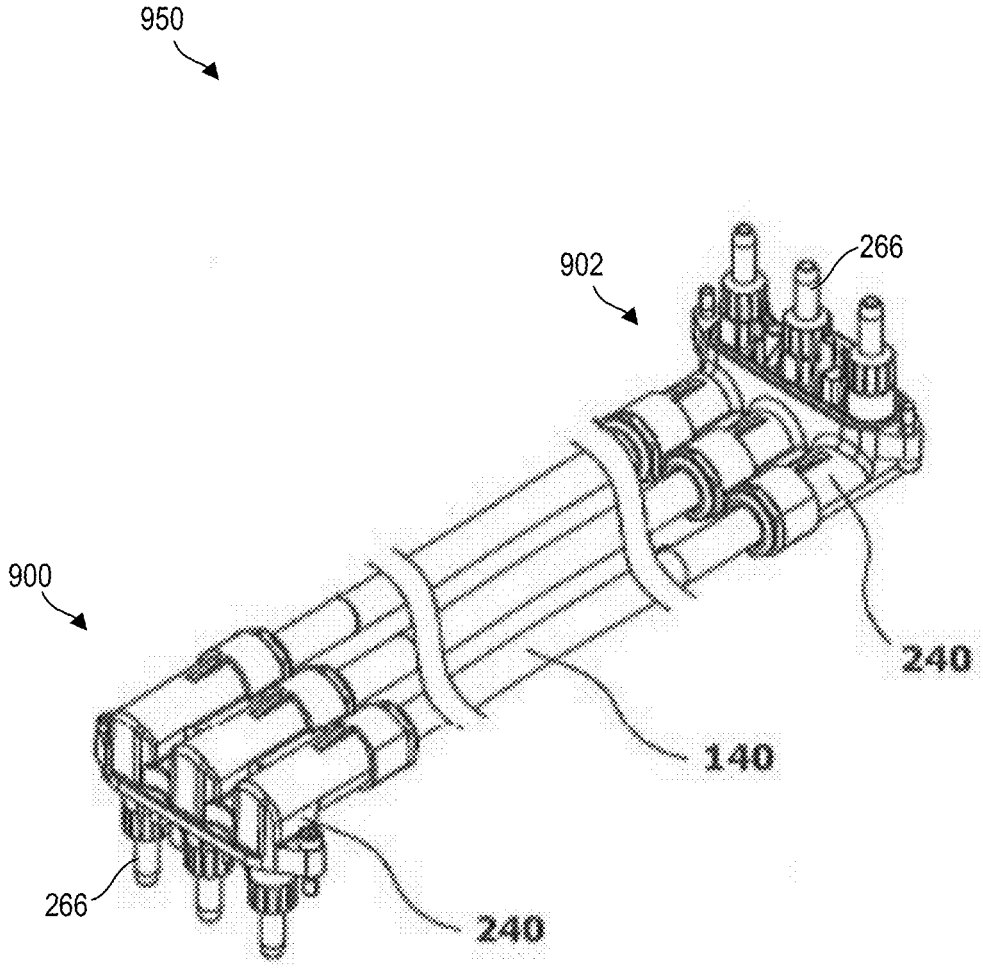
FIG. 9C shows a perspective view of a third example of a cable fitted with two "L" shaped plug members of different configurations than those of FIG. 9B according to the present disclosure.
Figure 10A:
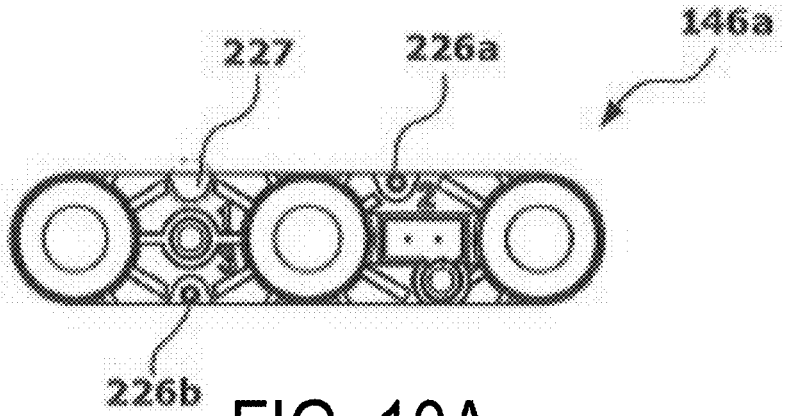
FIG. 10A shows a first example of a pin protector module which may be implemented in a multiphase connector.
Figure 10B:
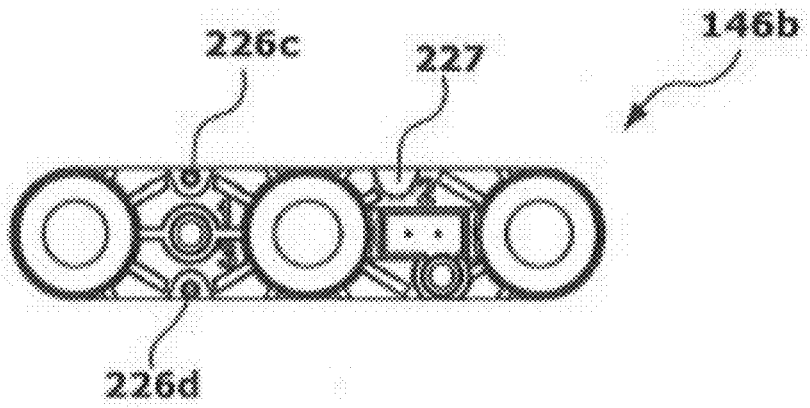
FIG. 10B shows a second example of a pin protector module which may be implemented in a multiphase connector.
Figure 10C:
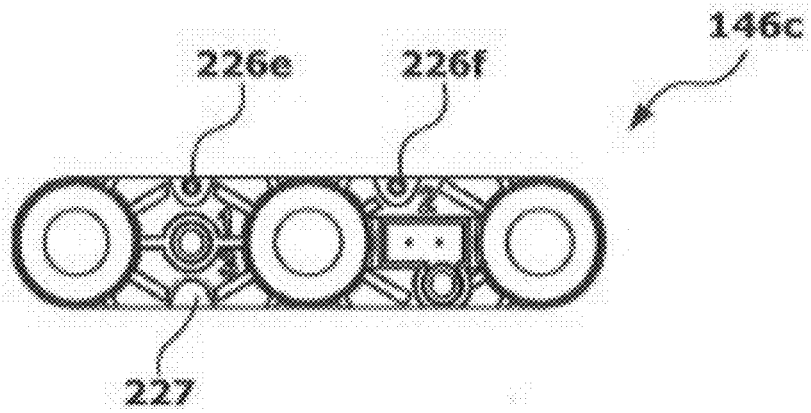
FIG. 10C shows a third example of a pin protector module which may be implemented in a multiphase connector.
Figure 11A:
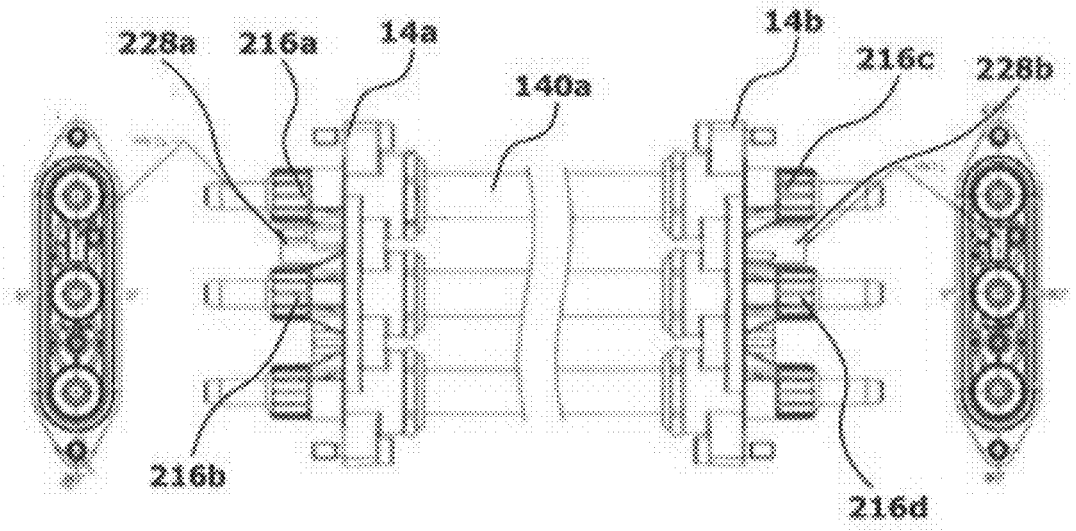
FIG. 11A shows a fourth example of a cable fitted with plug members and a first arrangement of a HVIL connector.
Figure 11B:
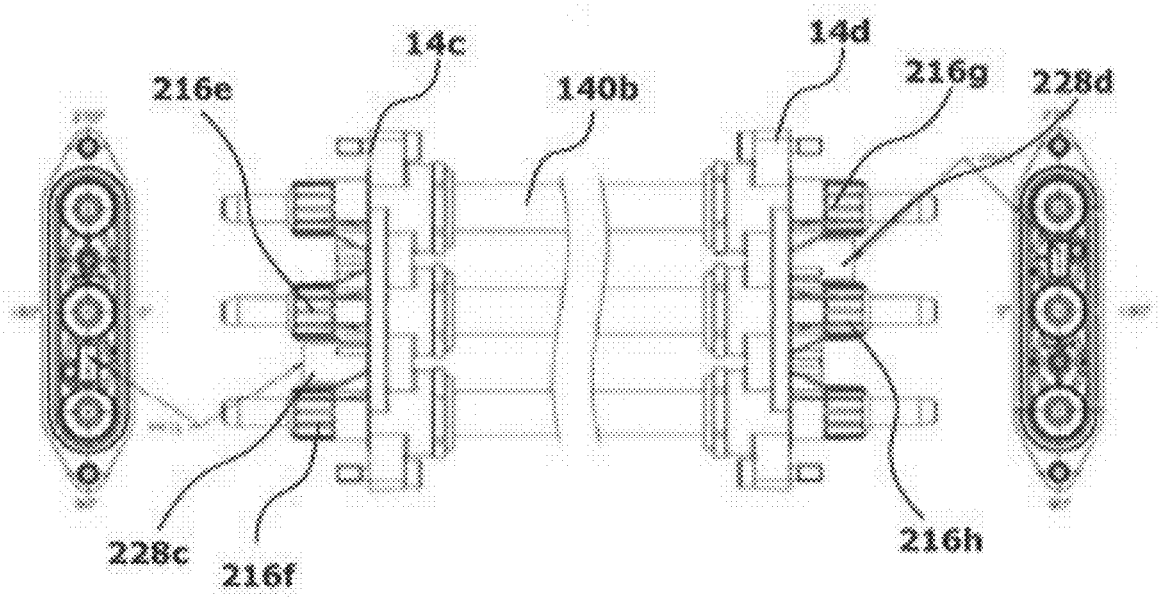
FIG. 11B shows a fifth example of a cable fitted with plug members and a second arrangement of a HVIL connector.

Installation of electrical connectors for electric powertrains may be hindered by use of tools to enable assembly of the connectors in desired locations. Conventional connectors include quick-connectors, which may include a plastic body, e.g., non-conductive body, and do not demand use of tools but may suffer from poor contact between a shield and main contact due to movement. Conventional connectors also include pass-through connectors which rely on electrical contact between a lug and bolt and provide robust electrical contact. However, the electrical contact is enabled by use of tools to fasten the lug and bolt connection. An electrical connector with strong electrical contact and readily installed in the electric powertrain without use of tools is thus desirable. The issues described above may be at least partially addressed by a multiphase connector described herein. An example of the multiphase connector having a first (e.g., 180 degree or straight) configuration is shown from various views in FIGS. 1-6. A second (e.g., 90 degree or L-shaped) configuration is shown from various views in FIGS. 7-8B. In some examples, the first configuration and the second configuration may be used in different combinations when applied to a cable(s), as shown in FIGS. 9A-9C. A position of an HVIL connector may also be varied, as shown in FIGS. 11A-11B. The multi-phase connector may include a pin protector module, examples of which are depicted in FIGS. 10A-10C.

Figure 1:
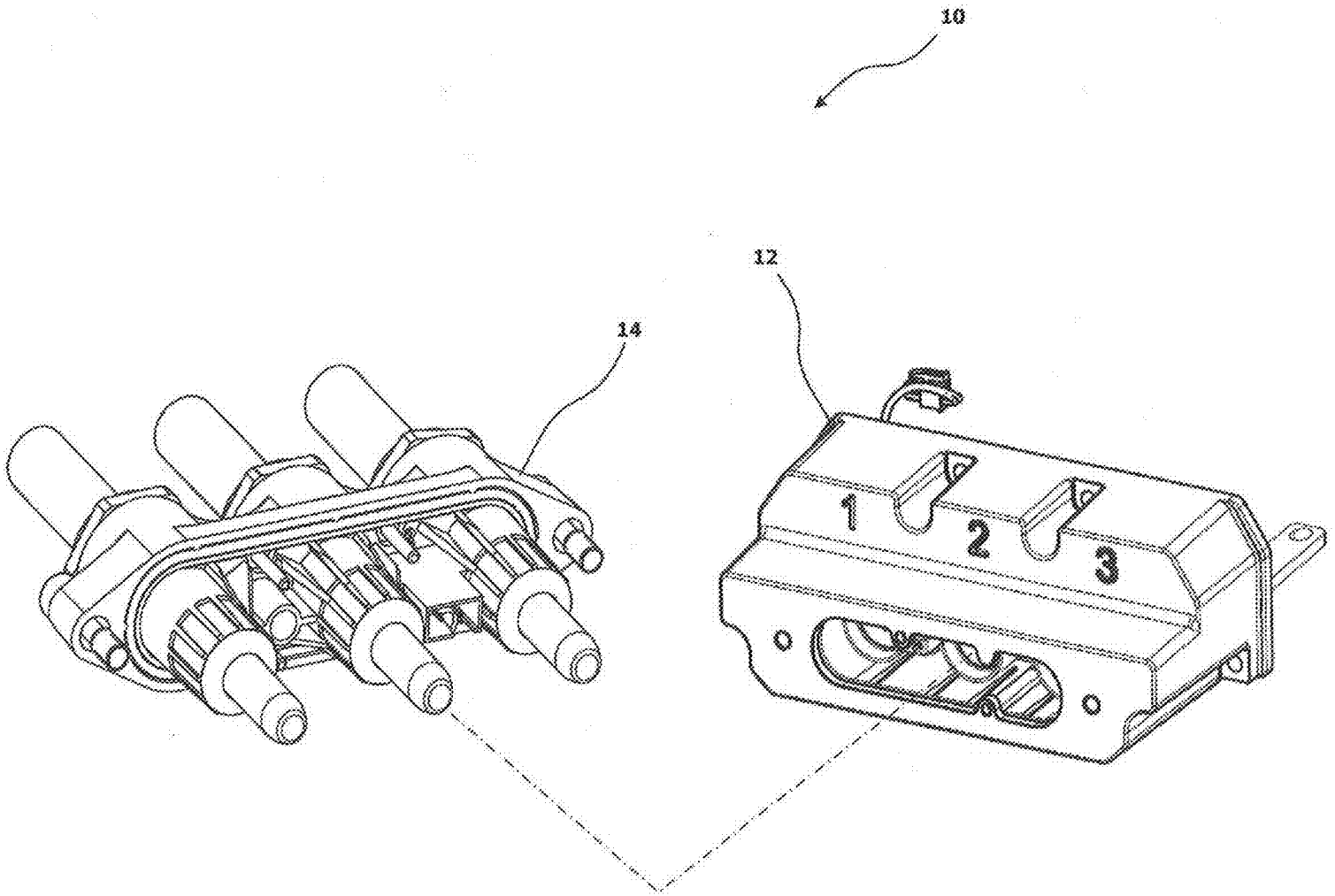
FIG. 1 shows a perspective view of a multiphase connector for an electric powertrain system according to an exemplary embodiment of the present disclosure.

Turning now to FIG. 1, a first example of a multiphase connector 10 is shown. The first example may be a straight, or 180 degree configuration. For example the multiphase connector 10 includes a terminal block 12 configured to receive a plug member 14 and the plug member 14 may be coupled to the terminal block 12 along a common axis.

Figure 2:
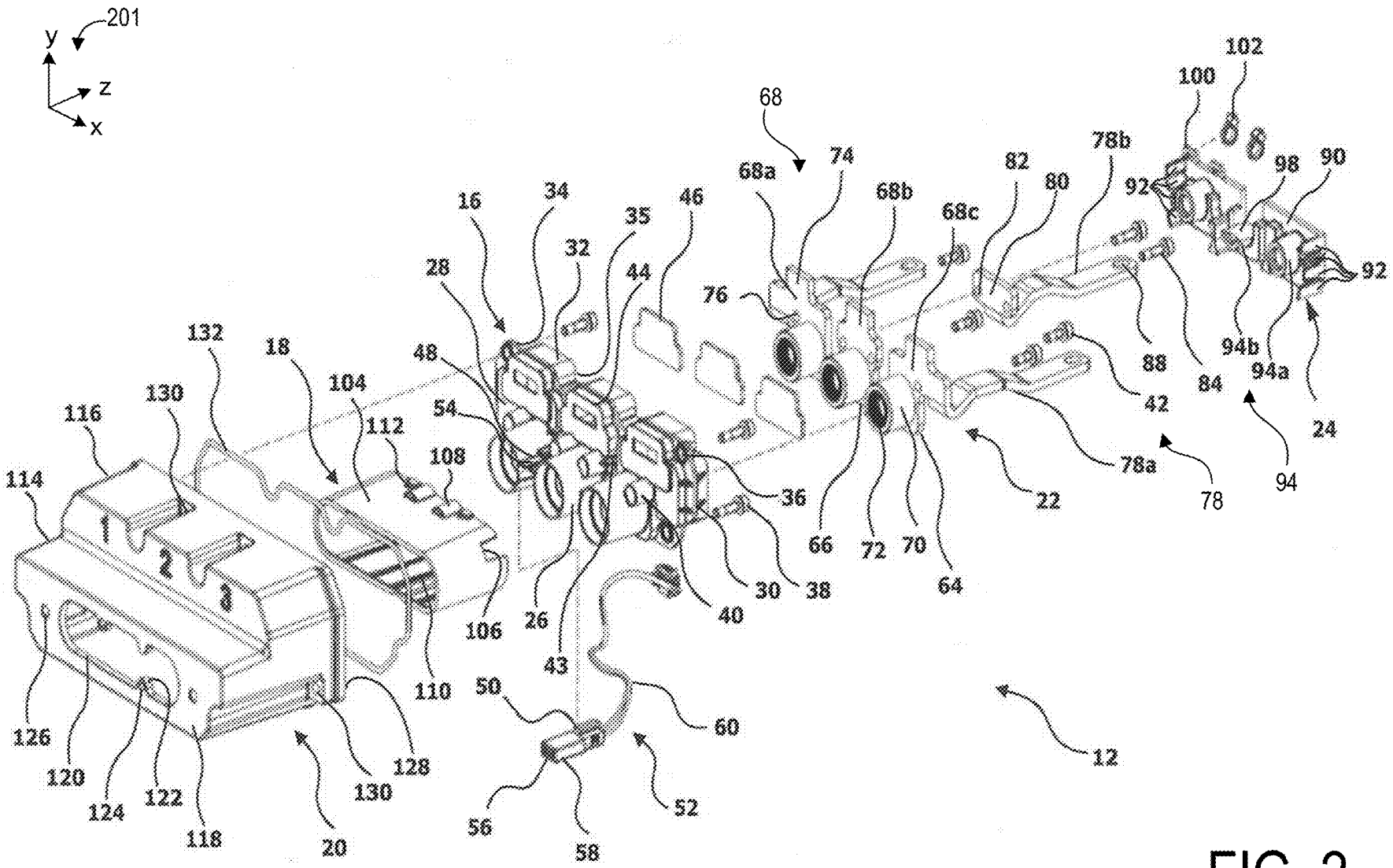
FIG. 2 shows an exploded view of the exemplary embodiment of the terminal block in FIG. 1.
Figure 3A:
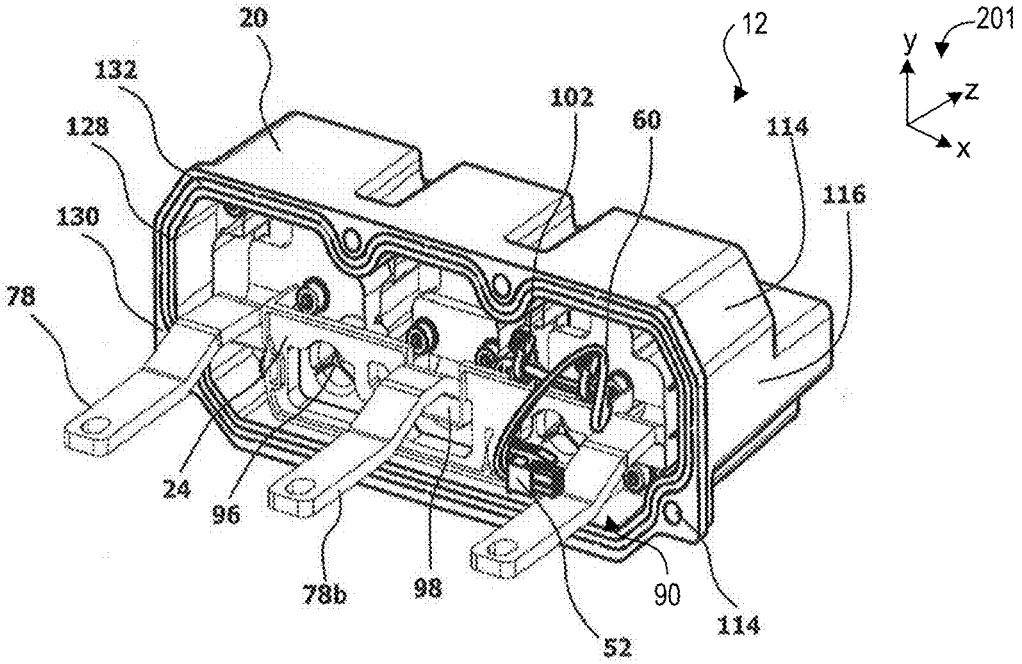
FIG. 3A shows a perspective view from a back side of the terminal block in FIG. 2 in assembled form.
Figure 3B:
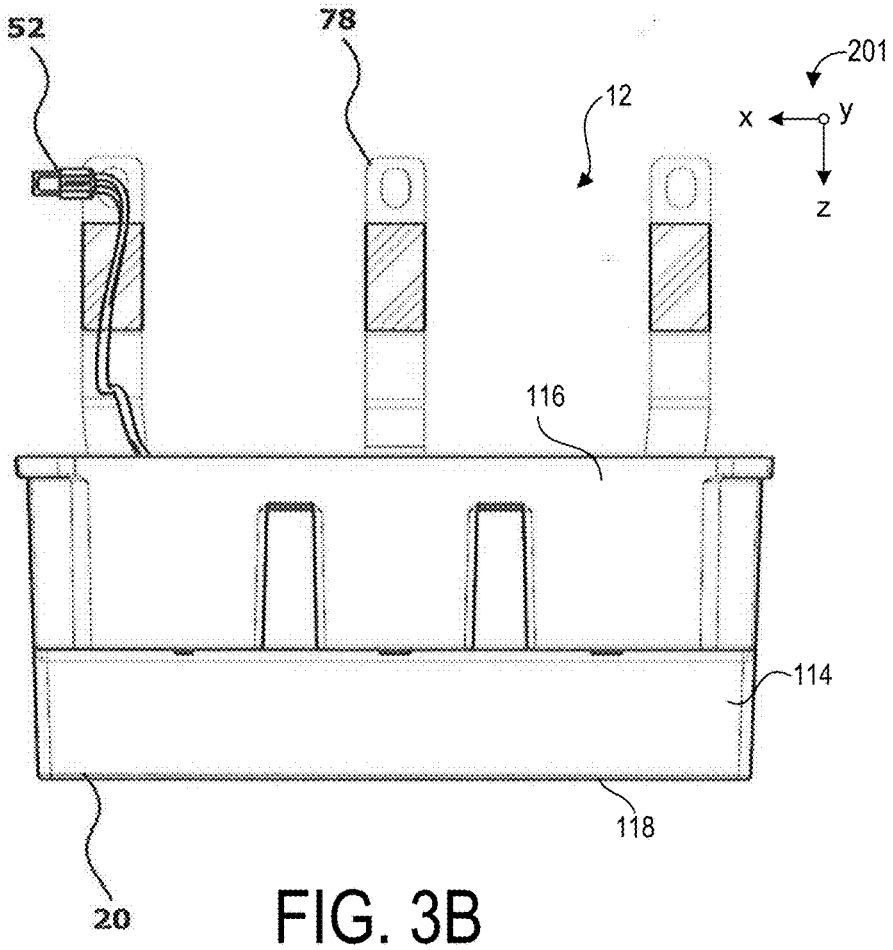
FIG. 3B shows a top view of the terminal block in FIG. 3A.

Referring now to FIGS. 2, 3A, and 3B, which illustrate an embodiment of terminal block 12 that includes a body 16, a tunnel member 18, a casing 20, a socket assembly 22, and end cover 24. A set of references axes 201 are provided for comparison between views shown in FIGS. 2-3B, indicating a y-axis, an x-axis, and a z-axis. FIG. 2 shows an exploded view of the terminal block 12, FIG. 3A shows a rear view of the assembled terminal block 12, and FIG. 3B shows a top view of the assembled terminal block 12.

In the illustrated embodiment, the body 16 is formed with three socket protectors 26 projecting perpendicularly from a first surface 28 of a base plate 30. The socket protectors 26 are configured to fittingly receive a contact socket from the socket assembly 22. It will be appreciated that the number of socket protectors 26 on the body 16 may vary in other examples to correspond to the number of contact sockets. A side wall 32 extends perpendicularly along the peripheral edges of a second surface 34 of the base plate 30, thereby forming a cavity 35 that is configured for receiving at least a portion of the socket assembly 22. One or more connection openings 36 are formed along the peripheral edges of the base plate 30 configured for receiving a corresponding number of fasteners 38, which secure the body 16 to casing 20. As shown, a plurality of fastening sleeves 40 are also formed on surface 28 of base plate 30 for receiving fasteners 42 which secure the socket assembly 22 onto the second surface 34 of the body 16. In some embodiments, as shown in FIG. 2, arms 43 are formed on surface 28 of base plate 30. On the distal end of the arms 43 is a snap joint projection configured to snap into corresponding openings in the tunnel member 18 to form a snap-fit joint. It is to be understood that the fasteners 38 and 42 may be any suitable fastening mechanism, such as screws, bolts, etc.

In the illustrated embodiment, a hollow projection 44 extends from the first surface 28 of base plate 30 in proximity to each of the socket protectors 26, thereby forming a corresponding cavity inside cavity 35 for receiving a thermal interface material, such as a thermal pad 46.

A High Voltage Interlock Loop (HVIL) mount 48 is formed on the base plate 30 configured for receiving a mounting mechanism 50 on a HVIL harness 52. In the illustrated embodiment, the mounting mechanism 50 is in the shape of a T-shaped prism. Correspondingly, the HVIL mount 48 in the illustrated embodiment comprises two support arms 54 spaced apart to fittingly receive and secure the mounting mechanism 50 as shown by the dotted line. It is to be appreciated those skilled in the art that any other types of connection mechanism between the HVIL mount and the body 16 may be adopted. The HVIL harness 52 houses a HVIL connector, such as a female HVIL connector 56 as shown, for receiving a corresponding HVIL connector, such as a male connector, that will be discussed in more detail below. The female HVIL connector 56 may comprise a plastic body 58 with, for example, gold plated contacts or any other suitable HVIL connector construction. In one example, the gold plated contacts may be Molex® CMC series contacts. The female HVIL connector 56 is connected, through a HVIL cable 60, to a vehicle HVIL system network.

At least a portion of the socket assembly 22 is configured to be fittingly received by cavity 35 of the body 16. In the illustrated embodiment, the socket assembly 22 comprises a plate 64 that includes a base portion 66 with three socket portions 68*a*, 68*b*, and 68*c* (collectively referred to as socket portions 68) extending therefrom. Alternatively, in some examples, the individual socket portions 68*a*, 68*b*, and 68*c* may be separate and distinct components. Each of the socket portions 68 includes a bottom portion upon which the contact socket 70 is formed. Each contact socket 70 may include, e.g., circumferentially surround or enclose, a retaining spring 72 near a first end where the contact pin is to be received. When assembled with the body 16, each contact socket 70 is fittingly received by the socket protector 26. In some embodiments, the contact socket 70 and retaining spring 72 may include a nickel and silver plating to inhibit fretting erosion. In the illustrated embodiment, each of the socket portions 68 also includes a top thermal contact portion 74 configured to be in physical contact with its corresponding thermal interface material, such as thermal pad 46 when the socket assembly 22 is assembled with the body 16. One or more openings 76 are formed on the socket portions 68 configured for receiving fasteners 42 that releasably engage with the fastening sleeves 40 on the body 16.

Each of the socket portions 68*a* and 68*c* has a bus bar 78*a* integrally formed thereon, extending in the opposite direction from the contact socket 70. For socket portion 68*b*, bus bar 78*b* may be a separate component. Bus bar 78*b* may be formed with a tab 80 on one end of the bus bar 78*b*, where one or more openings 82 are formed for receiving fasteners 84. Fasteners 84, similar to fasteners 42, are also received by openings 76 so that they may releasably engage the fastening sleeves 40 on the body 16 to secure the socket assembly 22 with the body 16. The construction of the bus bars 78*a* and 78*b*, collectively referred to as bus bars 78, may be any suitable kind known in the art. The bus bars 78 may include an elongated metal bar with a proximal end, such as the end with tab 80 on bus bar 78*b*, in contact or integrally formed with the socket portions 68. A contact opening 88 is formed on a distal end of the bus bars 78 for forming an electrical connection with an electric powertrain system component by bolted, clamped, or welded means as known in the art. Each of the socket portions 68 may be adapted with the integrally formed bus bar 78*ba* or the separately formed bus bar 78*b*. In addition, the construction of the socket portions and bus bars, whether 78*a* or 78*b*, are non-limiting examples. Other variations in a configuration of the socket portions and bus bars have been contemplated.

The end cover 24 is configured to be coupled to the socket assembly 22 from the end opposite to the contact sockets 70 as shown in FIG. 3A. The end cover 24 includes a back panel 90. A plurality of connection arms 92, as shown in FIG. 2, are formed along the sides of the back panel 90 as shown, and are configured to releasably engage, such as by forming a snap-fit connection, with one or more of the side edges of the socket portions 68. Projections 94*a* and semi-projection 94*b* (collectively referred to as projections 94) are formed on the back panel 90 so that each projection 94 aligns with the corresponding contact socket 70 from the back side. In the embodiment shown in FIG. 3A, additional ribs 96 may be formed within each of the projections 94*a*. In one aspect, the projections 94 may be configured to block foreign object bodies from entering the terminal block 12 that could cause a short circuit when it is uncoupled from the plug member 14. It is to be understood that the number of projections 94 may vary according to the number of contact sockets and the construction of projections 94 may be any of that known in the art. In the illustrated embodiment shown in FIG. 2, cable tie tabs 100 are formed on the back panel 90 to receive cable ties 102, which may be used to secure one or more loose wires such as the HVIL cable 60 as shown in FIG. 3A.

In the example shown in FIG. 2, the tunnel member 18 is included to, at least in part, inhibit foreign bodies from entering and causing a short circuit with the contact sockets. The tunnel member 18 may include a wall member 104 enclosed to define a hollow interior that is configured to receive all of the socket protectors 26 of the body 16. As shown, one or more indentations 106 and/or projections 108 are formed on the exterior surface of wall member 104 to accommodate the fastening sleeves 40. In the embodiment shown, ribs 110 are formed lengthwise along the interior surface of wall member 104 where the ribs 110 are configured to guide and position the socket protectors 26 inside the tunnel member 18, which may minimize lateral movements of the socket protectors 26 that may be caused by vibrations of the system. Snap-fit openings 112 are formed through wall member 104 to receive the snap joint projection of the arm 43 from the body 16 as discussed above.

As shown in FIGS. 2 and 3B, the casing 20 includes a lower portion 114 and a top portion 116. A front side of the lower portion 114 is defined by a mounting interface 118. The mounting interface 118 includes a plug opening 120, as shown in FIG. 2, configured to receive at least a portion of the plug member 14 of FIG. 1 with the remaining portions of the mounting interface 118 abutting against a base of the plug member 14 as discussed in more detail below. One or more key tabs 122 may extend, at least partially, into the plug opening 120. One or more key tabs 122 are formed with a key opening 124 configured to receive a keying pin from the plug member 14 as discussed in more detail below. Also formed through the mounting interface 118 are one or more fastener openings 126 for receiving a corresponding number of fasteners on the plug member 14.

The lower portion 114 is configured to house the tunnel member 18 along with socket protectors 26 and contact sockets 72 when the terminal block 12 is assembled. The top portion 116 of the casing 20 is configured to accommodate the remaining portions of the assembly of the body 16, tunnel member 18, and socket assembly 22. In the illustrated embodiment, the top portion 116 is configured to receive the projections 44 from the body 16 which further contains the thermal pads 46 and parts of the socket portions 68, such as the thermal projections 74. As shown in FIGS. 3A and 3B, the casing 20 is dimensioned so that when assembled, only portions of the bus bars 78 and the free end of HVIL harness 52 expends beyond the casing 20 from opening 128 at the back surface 130 of casing 20 opposite to the mounting interface 118. One or more fastener openings 126 may be formed on the casing 20 for receiving fasteners (not shown) so that the casing 20 may be coupled to the surface of the electric powertrain system component. In the illustrated embodiment, an O-ring 132 may be configured to fit along the perimeter of the casing 20 around the opening 128 so as to be able to provide a sealing connection between the electric powertrain system component surface and the back surface 130 of the casing 20. It is to be understood that the electric power train system component to which the casing 20 is attached serves as an electrical ground. Further, the casing 20 may be manufactured from a suitable metal conductor, such as copper, brass, stainless steel, aluminum, and other alloys. Accordingly, the casing 20, made of a conducting metal, not only improves the resiliency of the terminal block 12, but also provides an electrical grounding path for the shield contact as will be discussed in more detail below. It is to be understood that the illustrated embodiment of the terminal block is but one embodiment, and other configurations of the terminal block may be possible.

Figure 4:
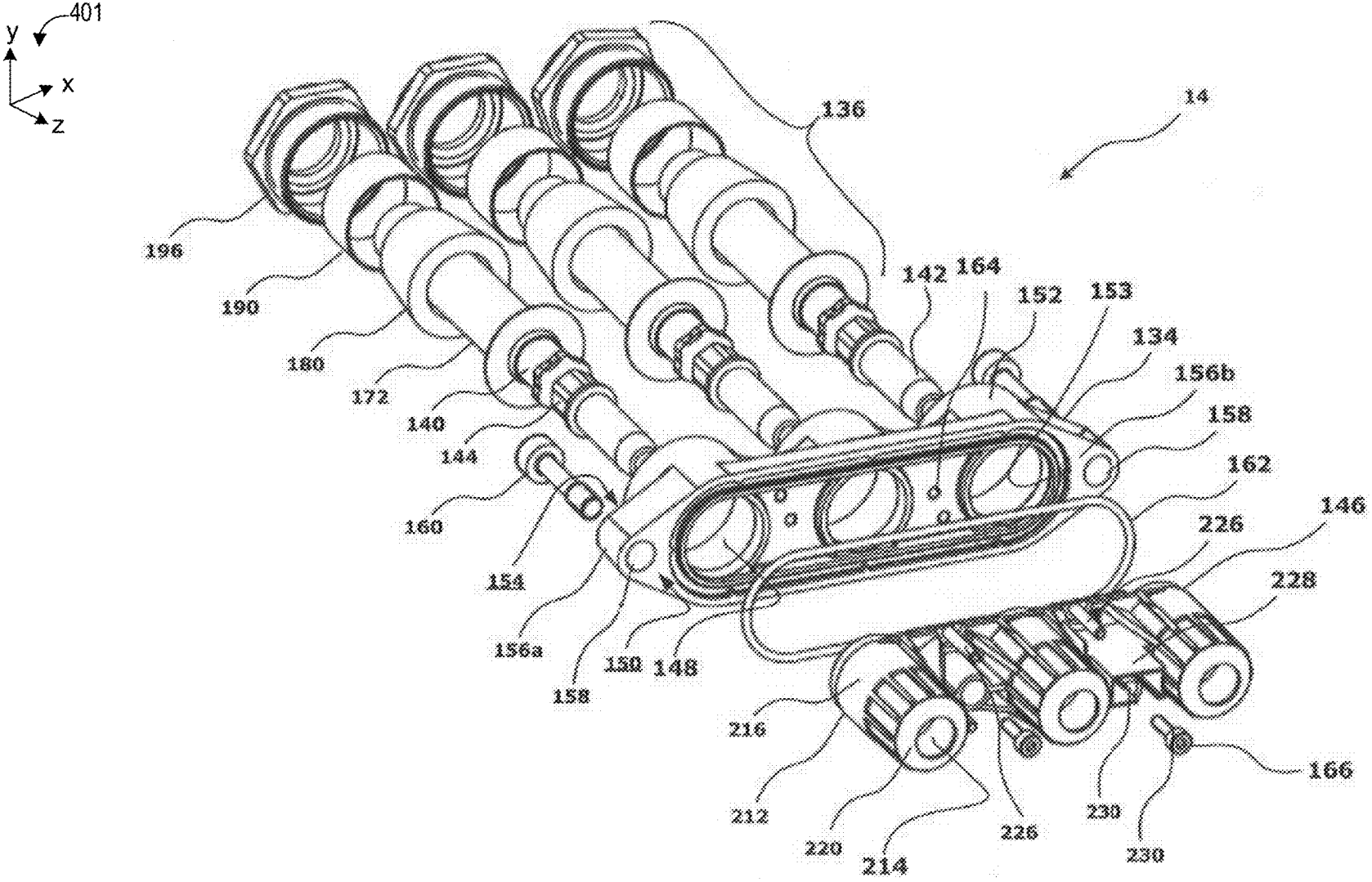
FIG. 4 shows an exploded view of an exemplary embodiment of the plug member in FIG. 1 having a straight fitting projection.
Figure 5A:
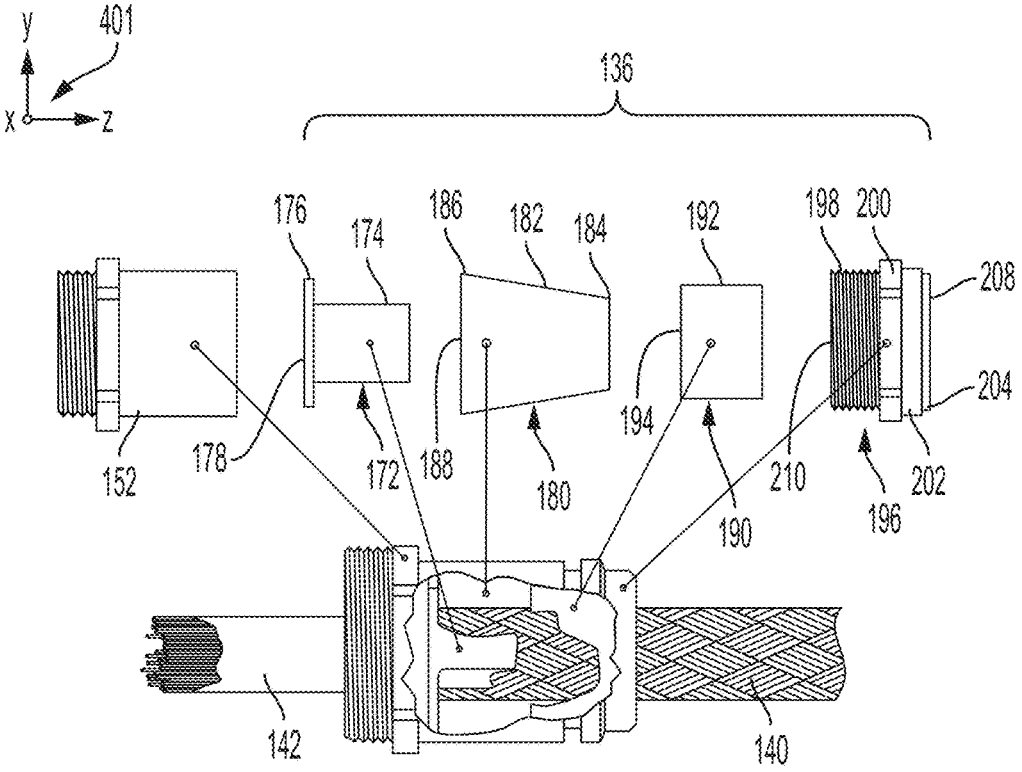
FIG. 5A shows an elevation view of the assembly of the cable gland assembly in FIG. 4.
Figure 5B:
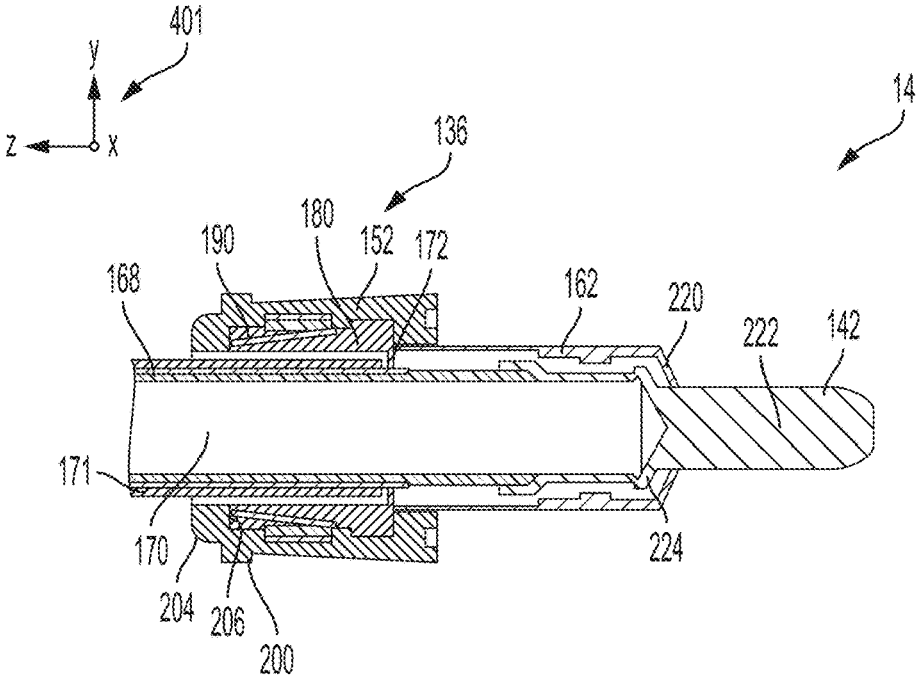
FIG. 5B shows a cross-sectional view of the plug member in FIG. 4.

Now referring to FIGS. 4, 5A, and 5B, they show one example of the plug member 14 configured to be insertable into the terminal block 12. A set of references axes 401 are provided for comparison between views shown in FIGS. 4-5B, indicating a y-axis, an x-axis, and a z-axis. The plug member 14 includes a base 134 configured to couple to, and to house, one or more cable gland assemblies 136, each of which is mounted upon a shielded cable 140. A contact pin 142 may be coupled to each shielded cable 140 via a connector 144. A pin protector module 146 is configured to be coupled to the base 134 so as to snugly receive the contact pins 142.

The contact pins 142 are configured to be fittingly received by the contact sockets 70 of the terminal block 12 of FIGS. 1-3B, forming one or more main electrical contacts. The pin-and-socket method of coupling removes a dependency on installation tools to install the multiphase connector, which may allow the connection between the terminal block 12 and the plug member 14 to be achieved in a faster and less labour intensive manner. As such, the terminal block 12 and the plug member 14 may be fixedly engaged with one another with relying on tools to facilitate the engagement.

As shown in FIG. 4, the base 134 comprises three apertures 148, each extending from a first side 150, through a fitting projection 152, to a second side 154 of the base 134. Fitting projection 152 is a straight fitting projection that extends 180-degrees away from the front of base 134. Thus, the embodiment may also be referred to as the "180-degree plug member". It will be appreciated that the number of apertures 148 corresponds to the number of contact pins 142 in the plug member 14 which may vary based on the number of phases of the electrical signal. The interior surface of each of the fitting projections 152 on the second side 154 may be profiled with helical ribs (not shown) for coupling with the cable gland assembly 136 as discussed in detail below. Furthermore, it will be appreciated that other types of connection mechanisms between the base 134 and the cable gland assembly 136 may be possible. Each fitting projection 152 is of sufficient length so that the entire cable gland assembly 136 may be housed therewithin. The apertures 148 are formed within a recessed area 153 on the first side 150 of the base 134 for receiving at least a portion of the pin protector module 146. The fitting projection 152 may also be made of conductive material which in part completes the grounding path for the cable shield contact.

The illustrated embodiment of base 134 also includes two flanges 156*a* and 156*b* extending from opposing sides of the base 134. Each flange 156*a*, 156*b* is configured with a fastener opening 158 to receive a fastener 160, which is configured for engaging the one or more fastener openings 126 on the mounting interface 118 of the terminal block 12. In some embodiments, the fasteners 160 may be captive screws to provide a more permanent connection between the terminal block 12 and plug member 14. By configuring the fasteners 160 as captive screws, movement of the electrical contact may be mitigated and the main electrical contact between the contact pins 142 and contact sockets 70 may be maintained.

The base 134 is also manufactured from a suitable metal conductor, such as copper, brass, stainless steel, aluminum, and other alloys. Accordingly, when the plug member 14 is inserted into terminal block 12, the base 134 is in electrical contact with the mounting interface 118 of the casing 20 of the terminal block 12, which completes an electrical grounding path for the cable shield as will be discussed in more detail below. By forming both the terminal block casing 20 and plug member base 134 from a metal conductor, a conductive path for shield contact grounding is provided which may further simplify the shield contact configuration and lower a cost of manufacturing. In addition, the metal casing 20 and base 134 may be plated to provide resistance to weathering.

An O-ring 162 is configured to be compressed between the base 134 and mounting interface 118 to provide a seal compression between the terminal block 12 and plug member 14 upon coupling. Further, as shown in FIG. 4, one or more fastener openings 164 are formed on the first side 150 of the base 134 to receive fasteners 166 for coupling the pin protector module 146 onto the base 134.

As it is known in the art, shielded cable 140 comprises a shield 168 covering an electrical cable 170, as shown in FIG. 5B. The shield 168 may minimize electromagnetic interference emitted from the electrical cable 170 so as to comply with relevant automotive regulations. The shield 168 is typically covered with a plastic jacket 171. The cable gland assembly 136 is mounted onto each shielded cable 140 to at least in part ensure the shield contact of the shielded cable 140.

Figure 6:
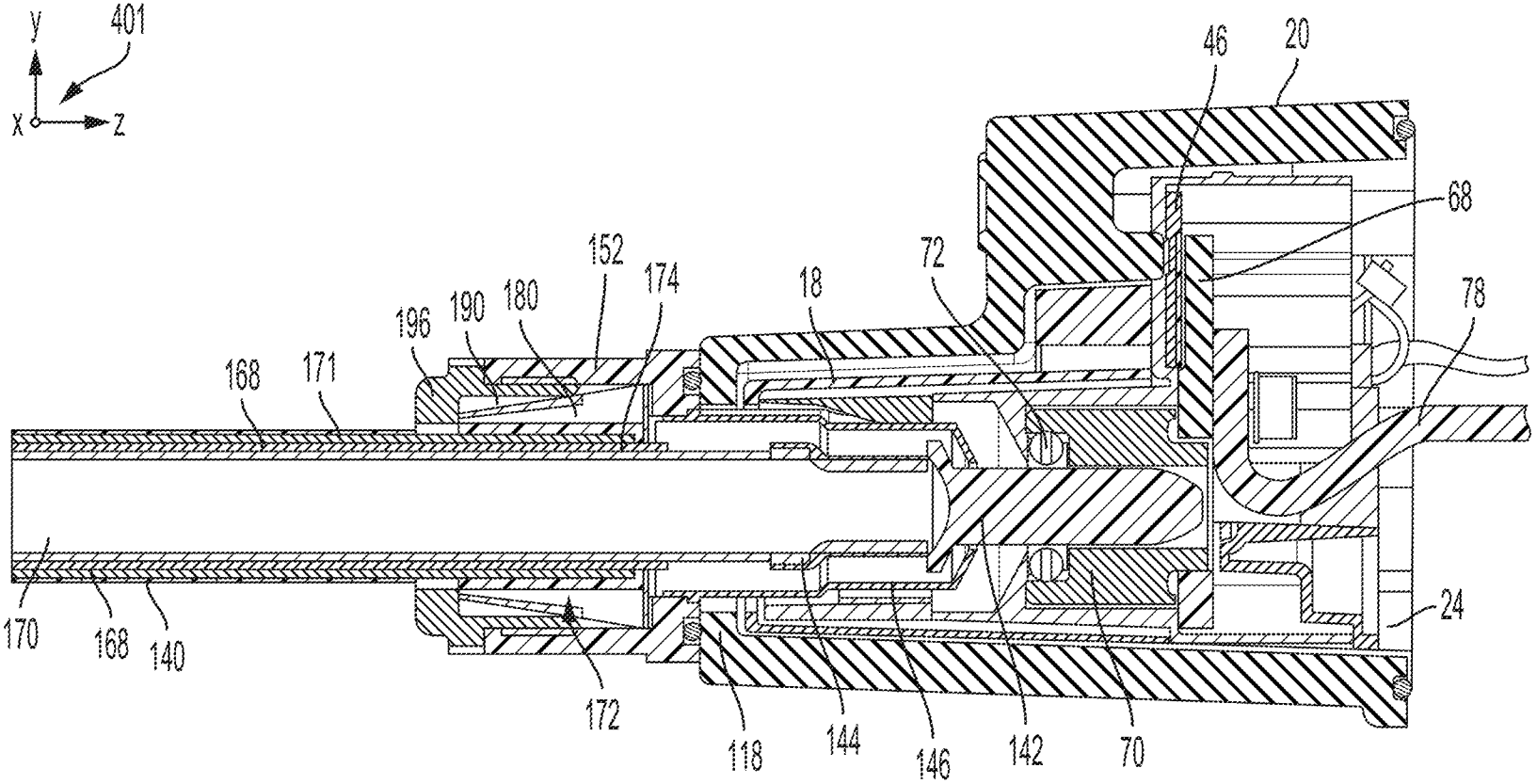
FIG. 6 shows a cross-sectional view of the multiphase connector in FIG. 1 with the plug member inserted into the terminal block.

As shown in FIG. 5A, the cable gland assembly 136 includes grounding or earthing sleeve 172 mounted directly over the shielded cable 140, and encased within the cable gland assembly 136. In other words, the earthing sleeve 172 may be a sleeve that provides electrical grounding. In particular, the earthing sleeve 172 comprises a tubular body 174 with circular flange 176 at one end of the tubular body 174. A central bore 178 in earthing sleeve 172 is dimensioned to accommodate the electrical cable 170 covered with the shield 168 of FIG. 5B. As shown in FIG. 6, the tubular body 174 is configured to be positioned in between the shield 168 and the plastic jacket 171, thereby defining the shield contact for the shielded cable 140. The earthing sleeve 172 advantageously provides large contact surface with the shield 168, without applying any undue stress upon it. In some embodiments, a lengthened tubular body 174 of the earthing sleeve 172 may be adopted for additional contact surface area with the shielded cable 140 and hence an improved shield contact. For example, the tubular body 174 may be 14.5 mm long. As shown in FIGS. 4 and 5A, the circular flange 176 is configured so as to abut against an internal surface of fitting projection 152 which inhibits earthing sleeve 172 from escaping out of the fitting projections 152 from the first side 150 of the base 134. The contact with fitting projection 152 also provides an electrical grounding path for the shield contact.

In the illustrated embodiment, a sealing cone 180, as a part of the cable gland assembly 136, is positioned over the earthing sleeve 172. The sealing cone 180 is configured to ensure electrical contact between the earthing sleeve 172 and the fitting projection 152, as well as maintain the shield contact between the earthing sleeve 172 and the cable shield 168. In the illustrated embodiment of the sealing cone 180, the sealing cone 180 includes a frusto-conical shaped body 182 with a first end 184 having a first diameter and a second end 186 having a second diameter greater than the first diameter, where a central bore 188 extends from the first end 184 to the second end 186. The central bore 188 is dimensioned to be fittingly positioned over the portion of the shielded cable 140 where tubular body 174 of the earthing sleeve 172 is positioned. When assembled, at least a portion of the second end 186 abuts against a portion of the circular flange 176, and central bore 178 of earthing sleeve 172 is in coaxial alignment with central bore 188 of the sealing cone 180. In some embodiments, the length of tubular body 174 is essentially similar to the length of the central bore 188, which may prevent any cable compression caused by the sealing cone 180.

The cable gland assembly 136 may further include a brass cone 190 configured to transfer force exerted upon it by the compression screw 196 onto the sealing cone 180. The illustrated embodiment of the brass cone 190 includes a tubular body 192 with a central bore 194. The central bore 194 is sized with a diameter that exceeds that of the first end 184, but less than that of the second end 186 of the sealing cone 180. Thus, when assembled, the brass cone 190 may slide partially over the sealing cone 180 from the first end 184 and abuts against the tapered exterior surface of the sealing cone 180. The length of the overlapping portion of the sealing cone 180 is less than, or equal to, the length of the brass cone 190 such that the first end 184 of the sealing cone 180 does not extrude out of the brass cone 190. In some embodiments, the central bore 194 may be tapered to match the exterior profile of the sealing cone 180 as shown in FIG. 5B such that the force exerted by the brass cone 190 may be more evenly distributed over the overlapping portion with the sealing cone 180.

As shown in FIGS. 5A and 6, the cable gland assembly 136 may also include a compression screw 196. The compression screw 196 includes a threaded portion 198, collar 200, and head portion 202. The threaded portion 198 is configured to threadingly engage the interior helical ribs of fitting projection 152. The collar 200 is configured to allow an installation tool to apply a force to the compression screw 196. In the illustrated embodiment of the compression screw 196, the head portion 202 has a tapered end 204 which forms an internal shoulder 206, and thereby defining an opening 208 with a diameter smaller than that of the internal bore 210, which may prevent sealing cone 180 from escaping from the opening 208 of the compression screw 196. The internal shoulder 206 provides an abutting surface for brass cone 190, and also the compression cone 180 in embodiments where the overlapping portion of the compression cone 180 equals the length of the brass cone 190 such as the one shown in FIG. 5B.

When assembled, the compression screw 196 threadingly engages fitting projection 152 of the base 134, which causes the internal shoulder 206 of the compression screw 196 to force brass cone 190 onto the tapered exterior surface of the sealing cone 180 from the first end 184, which forces the second end 186 of the sealing cone 180 onto the flange 176 of the earthing sleeve 172. In turn, the circular flange 176 of the earthing sleeve 172 is forced up against the internal surface of the fitting projection 152, thus maintaining electrical grounding path from the earthing sleeve 172 to the fitting projection 152. As disclosed above, the fitting projection 152 is in electrical contact with the base 134, which is in electrical contact with the casing 20 of the terminal block 12, which is mounted onto and grounded by the electric powertrain system component. The first end 184 of the sealing cone 180, under the force from the brass cone 190, is configured to, at least in part, snugly fit over the cable plastic jacket 171. Accordingly, the earthing sleeve 172 may be kept in place, and thus the shield contact between the earthing sleeve 172 and the cable shield 168 is maintained.

It is to be understood that at least the earthing sleeve 172 and the fitting projection 152 are manufactured using any suitable conductive metal. Further, in some embodiments, the compression screw 196 is also made of a conductive metal such that the metal-to-metal contact between the fitting projections 152 and the compression screw 196 may ensure a force is maintained through the lifespan of the cable gland assembly 136, even with sealing cone compression set, thereby ensuring shield contact for the shielded cable 140 is maintained.

It will be appreciated that the sizes of the earthing sleeve 172, compression cone 180, brass cone 190, and compression screw 196 may be varied to accommodate different sizes of the shielded cable 140, which for example, may be 40, 50, 70, or 85 $mm^2$ cables.

As shown in FIG. 4, the pin protector module 146 includes three pin protectors 212 each of which has a wall member 216 of frusto-conical shape defining a central bore 214. The number of pin protectors 212 may vary with the number of contact pins. An opening 218 is formed in the top portion 220. The opening 218 is dimensioned to snugly permit passage of a top portion 222 of contact pin 142, and so that the top portion 220 of the pin protector 212 abuts against the base flange 224 of the contact pin 142 as shown in FIG. 5B. As shown, the pin protector module 146 is partially received in the recessed area 153 on the base 134, and fastened onto the base 134 by one or more fasteners 166 which matingly engage with fastener openings 164.

Also formed on the pin protector module 146 are one or more keying pins 226 that are configured to be inserted into key openings 124 of the key tabs 122 on the mounting interface 118. A particular number and locations of the keying pins 226 on the pin protector module 146, along with the corresponding key tabs 122 with key openings 124, define a particular keying option which may be utilized to ensure correct pairing of terminal block 12 and plug member 14 intended for different purposes and/or to ensure correct insertion orientation of a plug member 14 into a terminal block 12. FIGS. 10A, 10B, and 10C illustrate the front elevation view of three example pin protector modules 146 with different keying options.

In particular, in FIG. 10A, a first pin protector module 146*a* comprises three locations that may correspond to a key tab 122 on the casing 20, and are labelled as locations "1", "2", and "3". In the embodiment shown in FIG. 10A, two keying pins 226*a* and 226*b* are formed on the first pin protector module 146*a* at locations labelled "2" and "3", which may each correspond to a key tab 122 on the casing 20 that does not have a key opening 124, as well as location "1", which may be a blank portion 227 that is without a keying pin. In FIG. 10B, the keying pins 226*c* and 226*d* are formed at locations "1" and "3", with location "2" being the blank portion 227 of a second pin protector module 146*b*. In FIG. 10C, the keying pins 226*e* and 226*f* are formed at locations "1" and "2", with location "3" being the blank portion 227 of a third pin protector module 146*c*.

As shown in FIG. 4, the pin protector module 146 further includes a male HVIL connector 228, which includes a jumper 230 that closes the HVIL loop when it is matingly engaged with the female HVIL connector 56 on the terminal block 12. Once assembled, the HVIL assembly may detect disconnects between the terminal block 12 and the plug member 14 and notify the vehicle HVIL system.

In some embodiments, the HVIL connector configuration may be varied to arrive at different configurations of cables utilizing the present plug member 14. Non-limiting examples are shown in FIGS. 11A and 11B. In particular, FIGS. 11A and 11B show two exemplary embodiments of shielded cable 140*a* and 140*b*, respectively, where each of the shielded cables 140*a*, 140*b* is fitted with two plug members 14 with straight fitting projections 152 but with different HVIL connector 228 arrangements. FIG. 11A shows shielded cable 140*a* fitted with plug members 14*a* and 14*b*. HVIL connector 228*a* is formed between pin protectors 216*a* and 216*b* on plug member 14*a*. On plug member 14*b*, the HVIL connector 228*b* is formed between pin protectors 216*c* and 216*d*. In FIG. 11B, shielded cable 140*b* is fitted with plug members 14*c* and 14*d*. HVIL connector 228*c* is formed between pin protectors 216*e* and 216*f* on plug member 14*c*. On plug member 14*d*, the HVIL connector 228*d* is formed between pin protectors 216*g* and 216*h*.

Returning to FIG. 4, the electrical connection formed between contact pin 142 and contact socket 70, as shown in FIG. 2, may generate considerable amounts of heat. With the socket assembly 22 being manufactured from a thermally conductive material, such as a metal, the generated heat may be dissipated through thermal interface material, such as a thermal pads 46, as shown in FIG. 2, which is in physical contact with at least a portion of the socket portion 68 of the socket assembly 22, and thereby in thermal contact with the contact socket 70 and contact pin 142 connection. It is to be understood that other types of thermal interface material may be used for heat dissipation.

Figure 7:
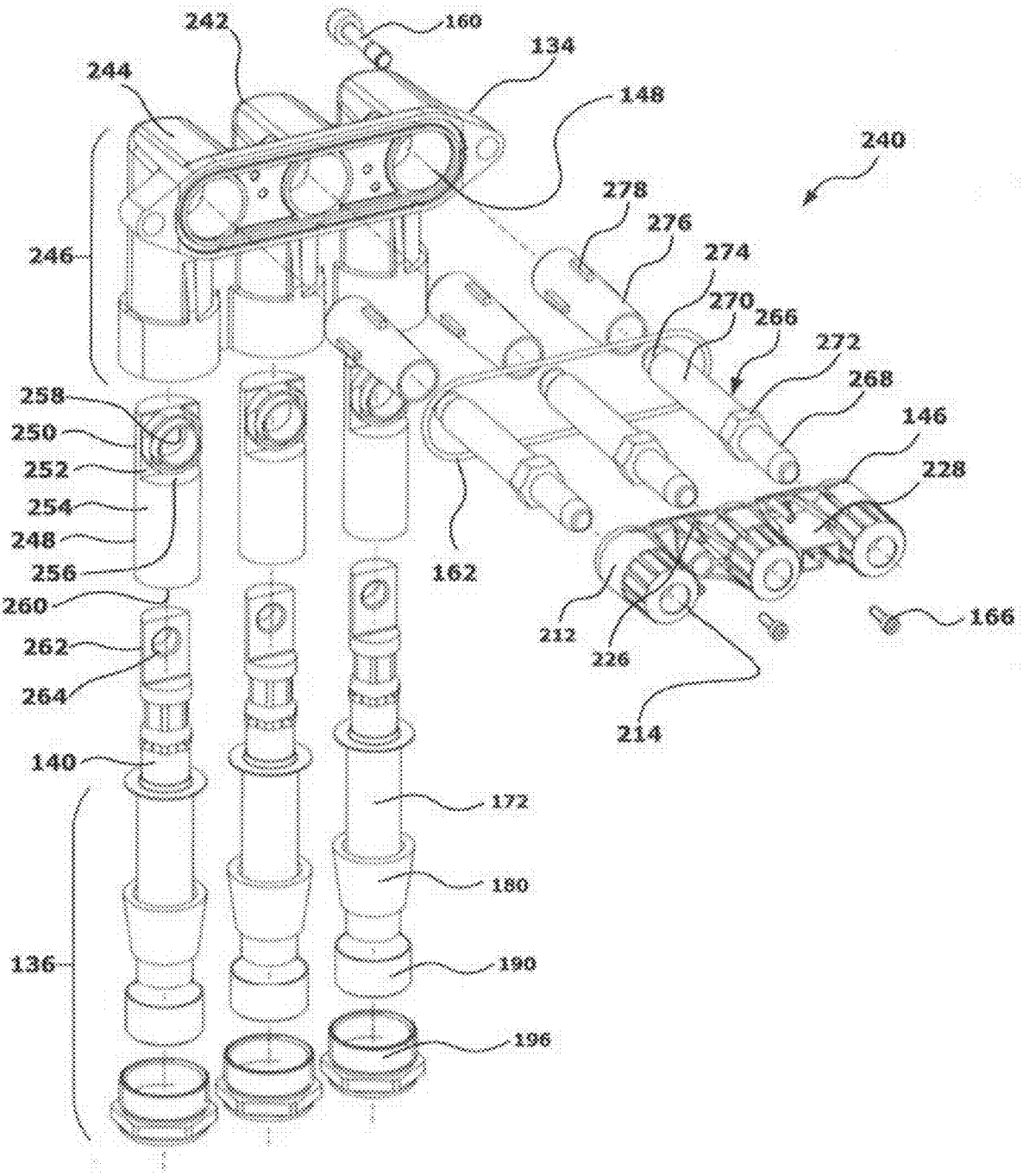
FIG. 7 shows an exploded view of another embodiment of the plug member with a "L" shaped fitting projection.
Figure 8A:
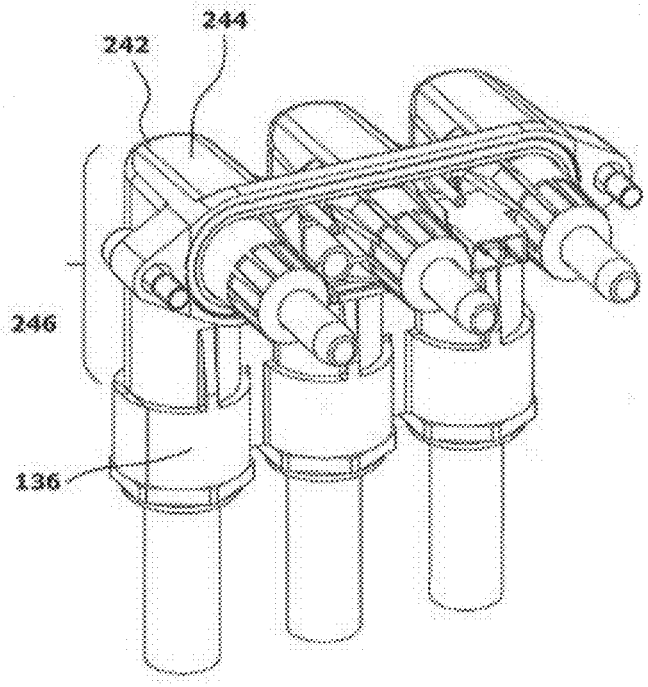
FIG. 8A shows a perspective view of the plug member in FIG. 7 in assembled form.
Figure 8B:
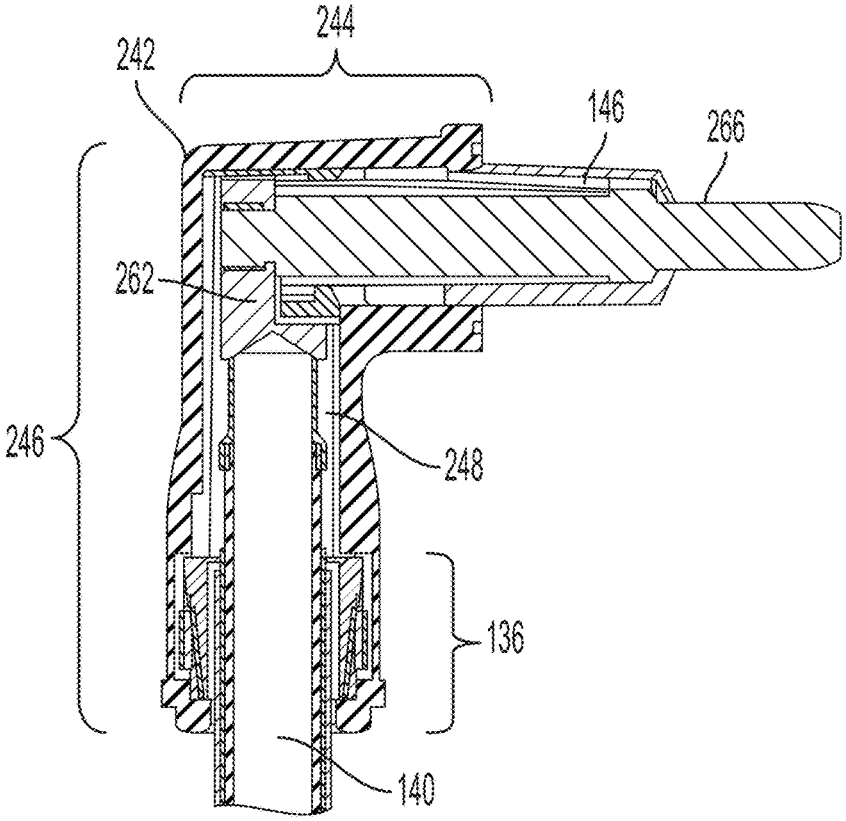
FIG. 8B shows cross-sectional view of the plug member in FIGS. 7 and 8A.

FIGS. 7, 8A and 8B show an exploded view of another example of a plug member 240 with an "L" shaped fitting projection, e.g., a 90 degree configuration. As shown in FIG. 7, the plug member 240 includes an electrically conductive metal base 134 with apertures 148 similar as that disclosed above. But instead of extending through a straight fitting projection 152, the base 134 of plug member 240 includes a plurality of "L" shaped fitting projections 242, each of which comprises a first body portion 244 forming an essentially 90 degree right angle with a second body portion 246. In some examples, the first body portion 244 may be 270 degrees from the second body portion 246. In other examples, the first body portion 244 and the second body portion 246 may form any angle between 90 and 270 degrees. The aperture 148 extends through the fitting projection 242.

A lug protector 248 may be received in the second body portion 246 of fitting projection 242. The lug protector 248, as shown, includes a semi-cylindrical portion 250 with a flat surface 252. The lug protector 248 further includes a cylindrical portion 254 separated from the semi-cylindrical portion 250 by an intermediate shoulder 256 that is generally flush with the bottom of the first body portion 244 when the lug protector 248 is inserted into the second body portion 246. On the flat surface 252 of the semi-cylindrical portion 250, an opening 258 is formed thereon which is in communication with internal bore 260 which extends through both of the semi-cylindrical portion 250 and the cylindrical portion 254. When assembled inside the fitting projection 242, the opening 258 is generally in coaxial alignment with the portion of aperture 148 in the first body portion 244.

Shielded cable 140 is coupled to a threaded lug 262 with a connection aperture 264. The top portion of the threaded lug 262 containing the connection aperture 264 generally conforms to the shape of the lug protector 248 as shown in FIG. 8B so that the threaded lug 262 can be fittingly inserted into the lug protector 248 where the connection aperture 264 coaxially aligns with opening 258 of the lug protector 248.

As shown in FIG. 8B, each shielded cable 140 is also fitted with cable gland assembly 136, the details of which are disclosed above and are omitted here for brevity. The cable gland assembly 136 threadingly engages to the free end of the second body portion 246 and thereby providing an electrical grounding path for the shield contact of the shielded cable 140 as disclosed above.

In the illustrated embodiment of FIG. 7, the plug member 240 further includes contact pins 266, each of which is configured to include a head portion 268 connected to a body portion 270 by a flange 272. The body portion 270 is configured to include a tail portion 274, which is configured to be fittingly inserted into connection aperture 264 of the threaded lug 262.

A pin protector 276 is configured to be placed over the body portion 270 of the contact pin 266 so that both ends of the pin protection 276 is positioned in between, and abutting against, the flange 272 and portions of the flat surface 252 of the lug protector 248 surrounding the opening 258. In the illustrated embodiment, one or more projections 278 are formed on the exterior surface of the pin protector 276. The projections 278 may serve as electrical insulation for the contact pin. Additionally, the projection 278 may also be dimensioned to center the contact pin 266 within the base 134.

The pin protector module 146 may be assembled onto the plug member 240 through fasteners 166 in a similar manner as those disclosed above, or any others suitable methods of connection. It will be appreciated that the number of contact pins and corresponding apertures may vary according to the number of phases in the electrical signal or design needs.

Now referring to FIGS. 9A to 9C, a cable assembly 950 is depicted, including an open ended shielded cable 140 may be fitted with two plug members at two, opposite ends. Thus, the straight, or 180-degree, plug member 14 and the "L" shaped, or 90-degree, plug member 240 may be used in combination and coupled to the opposite ends of the cable 140 to form cables that may accommodate system configurations demanding differently oriented plug members. FIG. 9A shows a straight plug member and a "L" shaped plug member coupled to each shielded cable 140; FIGS. 9B and 9C show shielded cables 140 each fitted with two "L" shaped plug members 240, but with different orientations.

For example, the shielded cables 140 are coupled at a first end 900 to the straight plug member 14 and to a second, opposite end 902 to the "L" shaped plug member 240. In FIG. 9B, however, the shielded cables 140 are coupled at both ends to the "L" shaped plug member 240. The "L" shaped plug members 240 are oriented so that contact pins 266 are extending in a same direction at both the first end 900 and the second end 902 of the shielded cables 140. The shielded cables 140 are also coupled at both ends to the "L" shaped plug members 240 in FIG. 9C but the contact pins 266 are the first end 900 are extending in an opposite direction from the contact pins 266 at the second end 902. As alternate configurations, the shielded cable 140 may be fitted with two straight plug members 14 as shown in FIGS. 11A and 11B and described above.

Certain adaptations and modifications of the described embodiments can be made. Therefore, the above discussed embodiments are considered to be illustrative and not restrictive. The present disclosure is not to be limited in scope by the specific embodiments described herein. Further example embodiments may also include all of the steps, features, compositions and compounds referred to or indicated in this description, individually or collectively and any and all combinations or any two or more of the steps or features.

FIGS. 1-11B show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

Throughout this document, the use of the word "a" or "an" when used in conjunction with the term "comprising" in the claims and/or the specification may mean "one", but it is also consistent with the meaning of "one or more", "at least one", and "one or more than one". Similarly, the word "another" may mean at least a second or more. The words "comprising" (and any form of comprising, such as "comprise" and "comprises"), "having" (and any form of having, such as "have" and "has"), "including" (and any form of including, such as "include" and "includes") or "containing" (and any form of containing, such as "contain" and "contains"), are inclusive or open-ended and do not exclude additional, unrecited elements or process steps.

In the present specification and in the appended claims, various terminology which is directional, geometrical and/or spatial in nature such as "longitudinal", "horizontal", "front", "forward", "backward", "back", "rear", "upwardly", "downwardly", etc. is used. It is to be understood that such terminology is used for ease of description and in a relative sense only and is not to be taken in any way as specifying an absolute direction or orientation.

The embodiments described herein may include one or more range of values (for example, size, displacement and field strength etc.). A range of values will be understood to include all values within the range, including the values defining the range, and values adjacent to the range that lead to the same or substantially the same outcome as the values immediately adjacent to that value which defines the boundary to the range. For example, a person skilled in the field will understand that a 10% variation in upper or lower limits of a range can be totally appropriate and is encompassed by the disclosure. More particularly, the variation in upper or lower limits of a range will be 5% or as is commonly recognized in the art, whichever is greater.

Throughout this specification relative language such as the words 'about' and 'approximately' are used. This language seeks to incorporate at least 10% variability to the specified number or range. That variability may be plus 10% or negative 10% of the particular number specified.

In one embodiment, a multiphase connector includes a terminal block having a casing formed of a conducting metal with at least one socket surrounding a retaining spring and a plug member having at least one contact pin configured to be inserted into the at least one socket to fixedly engage the plug member with the terminal block without use of tools, the plug member including at least one cable gland assembly to ground the shielded cable and maintain electrical continuity between a shielded cable and the plug member. In a first example of the multiphase connector, a grounding sleeve is encased in each of the at least one cable gland assembly and configured to be in electrical contact with a shield of the shielded cable. A second example of the multiphase connector optionally includes the first example, and further includes, wherein the plug member further comprises at least one fitting projection coupled to the metal base, the at least one fitting projection made of conducting metal and configured to couple to the at least one cable gland assembly. A third example of the multiphase connector optionally includes one or more of the first and second examples, and further includes, wherein the at least one cable gland assembly has a metal compression screw formed of a conducting metal and configured to be coupled to the at least one metal fitting projection and wherein the grounding sleeve is encased by the coupled metal fitting projection and compression screw. A fourth example of the multiphase connector optionally includes one or more of the first through third examples, and further includes, wherein the at least one cable gland assembly further comprises a sealing cone with a frusto-conical shape with the first end having a first diameter and the second end having a second diameter greater than the first diameter and wherein the sealing cone has a central bore dimensioned to be positioned over a tubular body of the grounding sleeve. A fifth example of the multiphase connector optionally includes one or more of the first through fourth examples, and further includes, wherein a length of the grounding sleeve is the same as a length of the sealing cone. A sixth example of the multiphase connector optionally includes one or more of the first through fifth examples, and further includes, wherein the cable gland assembly further comprises a brass cone, the brass cone configured to transfer a force from the compression screw onto the sealing cone. A seventh example of the multiphase connector optionally includes one or more of the first through sixth examples, and further includes, wherein the brass cone has a diameter greater than the first diameter of the sealing cone but less than the second diameter of the sealing cone to allow the brass cone to slide at least partially over the sealing cone and wherein the brass cone has a tapered bore that matches the frusto-conical shape of the sealing cone. An eighth example of the multiphase connector optionally includes one or more of the first through seventh examples, and further includes, wherein the compression screw is configured to couple to the metal fitting projection at a first end and a second end of the compression screw has a shoulder defining an end opening with a diameter less than a diameter of the brass cone and wherein when the compression screw is coupled to the metal fitting projection, the shoulder exerts a force onto the brass cone.

In another embodiment, a multiphase connector includes a terminal block having a conductive casing, one or more key tabs, and at least one contact socket circumferentially surrounding a retaining spring, a plug member configured to contact a shielded cable, the plug member having a base with one or more fitting projections formed of a conductive material, one or more keying pins configured to be inserted into an opening of the one or more key tabs, and at least one contact pin configured to be inserted into the at least one contact socket, and a high voltage interlock loop coupled at a female side to the terminal block and at a male side to the plug member and configured to detect disconnection between the terminal block and the plug member. In a first example of the multiphase connector, the one or more fitting projections are straight with a 180 degree angle. A second example of the multiphase connector optionally includes the first example, and further includes, wherein the one or more fitting projections are "L" shaped with a first portion and a second portion arranged 90 degrees to one another. A third example of the multiphase connector optionally includes one or more of the first and second examples, and further includes, wherein the one or more fitting projections are bent with a first portion and a second portion arranged 270 degrees to one another. A fourth example of the multiphase connector optionally includes one or more of the first through third examples, and further includes, wherein the casing and the base are coupled using one or more fasteners and wherein the one or more fasteners are captive screws. A fifth example of the multiphase connector optionally includes one or more of the first through fourth examples, and further includes, wherein the insertion of the at least one contact pin into the at least one contact socket forms an electrically continuous connection and at least one thermal interface material is in contact with the connection. A sixth example of the multiphase connector optionally includes one or more of the first through fifth examples, and further includes, wherein the keying pins are formed on a pin protector module of the plug member and a positioning of the one or more keying pins at the plug member corresponds to a positioning of the opening of the one or more key tabs at the terminal block and wherein engagement of the one or more keying pins with the one or more key tabs is configured to guide insertion of the at least one contact pin into the at least one contact socket.

In yet another embodiment, a cable assembly includes a shielded cable with a first end and a second end opposite of the first end, a first plug member configured to be inserted into a first terminal block without use of a tool, the first plug member coupled to the first end of the shielded cable, a second plug member configured to be inserted into a second terminal block without use of a tool, the second plug member coupled to the second end of the shielded cable, wherein the each of the first plug member and the second plug member includes at least one cable gland assembly with a grounding sleeve configured to maintain electrical continuity between each of the first and second plug members and the shielded cable and each of the first plug and second plug members has one of a straight and a bent configuration. In a first example of the cable assembly, the first plug member and the second plug member have different configurations. A second example of the cable assembly optionally includes the first example and further includes, wherein the first plug member and the second plug member have a same configuration but oriented in opposite directions. A third example of the cable assembly optionally includes one or more of the first and second examples, and further includes, wherein the bent configuration includes an angle formed between portions of the first and second plug members anywhere between 90 to 270 degrees.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A multiphase connector for an electric powertrain system, comprising:

a terminal block having a casing formed of a conducting metal with at least one socket surrounding a retaining spring;

a plug member having at least one contact pin configured to be inserted into the at least one socket to fixedly engage the plug member with the terminal block without use of tools, the plug member including at least one cable gland assembly to ground the shielded cable and maintain electrical continuity between a shielded cable and the plug member; and a high voltage interlock loop coupled at a female side to the terminal block and at a male side to the plug member and configured to detect disconnection between the terminal block and the plug member.

2. The multiphase connector of claim 1, further comprising a grounding sleeve encased in each of the at least one cable gland assembly and configured to be in electrical contact with a shield of the shielded cable.

3. The multiphase connector of claim 2, wherein the plug member further comprises at least one fitting projection coupled to the metal base, the at least one fitting projection made of conducting metal and configured to couple to the at least one cable gland assembly.

4. The multiphase connector of claim 3, wherein the at least one cable gland assembly has a metal compression screw formed of a conducting metal and configured to be coupled to the at least one metal fitting projection and wherein the grounding sleeve is encased by the coupled metal fitting projection and compression screw.

5. The multiphase connector of claim 2, wherein the at least one cable gland assembly further comprises a sealing cone with a frusto-conical shape with the first end having a first diameter and the second end having a second diameter greater than the first diameter and wherein the sealing cone has a central bore dimensioned to be positioned over a tubular body of the grounding sleeve.

6. The multiphase connector of claim 5, wherein a length of the grounding sleeve is the same as a length of the sealing cone.

7. The multiphase connector of claim 5, wherein the cable gland assembly further comprises a brass cone, the brass cone configured to transfer a force from the compression screw onto the sealing cone.

8. The multiphase connector of claim 7, wherein the brass cone has a diameter greater than the first diameter of the sealing cone but less than the second diameter of the sealing cone to allow the brass cone to slide at least partially over the sealing cone and wherein the brass cone has a tapered bore that matches the frusto-conical shape of the sealing cone.

9. The multiphase connector of claim 8, wherein the compression screw is configured to couple to the metal fitting projection at a first end and a second end of the compression screw has a shoulder defining an end opening with a diameter less than a diameter of the brass cone and wherein when the compression screw is coupled to the metal fitting projection, the shoulder exerts a force onto the brass cone.

10. A multiphase connector, comprising:

a terminal block having a conductive casing, one or more key tabs, and at least one contact socket circumferentially surrounding a retaining spring;

a plug member configured to contact a shielded cable, the plug member having a base with one or more fitting projections formed of a conductive material, one or more keying pins configured to be inserted into an opening of the one or more key tabs, and at least one contact pin configured to be inserted into the at least one contact socket; and a high voltage interlock loop coupled at a female side to the terminal block and at a male side to the plug member and configured to detect disconnection between the terminal block and the plug member.

11. The multiphase connector of claim 10, wherein the one or more fitting projections are straight with a 180 degree angle.

12. The multiphase connector of claim 10, wherein the one or more fitting projections are "L" shaped with a first portion and a second portion arranged 90 degrees to one another.

13. The multiphase connector of claim 10, wherein the one or more fitting projections are bent with a first portion and a second portion arranged 270 degrees to one another.

14. The multiphase connector of claim 10, wherein the casing and the base are coupled using one or more fasteners and wherein the one or more fasteners are captive screws.

15. The multiphase connector of claim 10, wherein the insertion of the at least one contact pin into the at least one contact socket forms an electrically continuous connection and at least one thermal interface material is in contact with the connection.

16. The multiphase connector of claim 10, wherein the keying pins are formed on a pin protector module of the plug member and a positioning of the one or more keying pins at the plug member corresponds to a positioning of the opening of the one or more key tabs at the terminal block and wherein engagement of the one or more keying pins with the one or more key tabs is configured to guide insertion of the at least one contact pin into the at least one contact socket.

17. A cable assembly, comprising:

a shielded cable with a first end and a second end opposite of the first end;

a first plug member configured to be inserted into a first terminal block without use of a tool, the first plug member coupled to the first end of the shielded cable;

a second plug member configured to be inserted into a second terminal block without use of a tool, the second plug member coupled to the second end of the shielded cable; and a high voltage interlock loop coupled at a female side to the terminal block and at a male side to the plug member and configured to detect disconnection between the terminal block and the first plug member, wherein the each of the first plug member and the second plug member includes at least one cable gland assembly with a grounding sleeve configured to maintain electrical continuity between each of the first and second plug members and the shielded cable and each of the first plug and second plug members has one of a straight and a bent configuration.

18. The cable assembly of claim 17, wherein the first plug member and the second plug member have different configurations.

19. The cable assembly of claim 17, wherein the first plug member and the second plug member have a same configuration but oriented in opposite directions.

20. The cable assembly of claim 17, wherein the bent configuration includes an angle formed between portions of the first and second plug members anywhere between 90 to 270 degrees.

* * * * *